US005383440A

United States Patent [19]

Koishikawa et al.

[11] Patent Number: 5,383,440

[45] Date of Patent: Jan. 24, 1995

[54] BLOW-BY GAS CIRCULATING SYSTEM FOR 4-CYCLE ENGINE

[75] Inventors: Kouji Koishikawa; Motoyoshi Shishido; Toyokazu Kawasaki, all of Wako, Japan

[73] Assignee: Honda Giken Kogyo Kabushiki Kaisha, Tokyo, Japan

[21] Appl. No.: 120,961

[22] Filed: Sep. 15, 1993

[30] Foreign Application Priority Data

Sep. 16, 1992 [JP] Japan ..... 4-246912
Aug. 31, 1993 [JP] Japan ..... 5-216362

[51] Int. Cl.[6] ..... F01M 13/04; B63H 21/26
[52] U.S. Cl. ..... 123/572; 123/196 W
[58] Field of Search ..... 123/572, 573, 574

[56] References Cited

U.S. PATENT DOCUMENTS 3,167,060 1/1965 Fowler et al. ..... 123/572
3,545,416 12/1970 Brimer ..... 123/572
3,665,906 5/1972 De Palma ..... 123/572
3,769,798 11/1973 Whittaker ..... 123/572
3,889,649 6/1975 Polaner ..... 123/572
4,066,055 1/1978 Hager ..... 123/572
4,601,267 7/1986 Kronich ..... 123/572
5,067,449 11/1991 Bonde ..... 123/572
5,080,082 1/1992 Mueller et al. ..... 123/572

*Primary Examiner*—E. Rollins Cross
*Assistant Examiner*—M. Macy
*Attorney, Agent, or Firm*—Armstrong, Westerman, Hattori, McLeland and Naughton

[57] ABSTRACT

An engine E of an outboard motor O includes a carburettor 29 at an upstream end of an intake manifold 28, and an air intake 30 is detachably fixed to the carburettor 29 by two bolts 44. A cylinder block 21 of the engine E and a coupling portion 30-2 of the air intake 30 are interconnected through blow-by gas passages 40 and 41 with an oil separating chamber 39 interposed therebetween. The coupling portion 30-2 is provided at a location offset upwardly from axes of the two bolts 44. Therefore, both of the operation of the bolts 44 for attaching and detaching the air intake 30 and the operation of attaching and detaching the blow-by gas passage 41 to and from the coupling portion 30-2 can be conducted without any hindrance.

4 Claims, 19 Drawing Sheets

BLOW-BY GAS CIRCULATING SYSTEM FOR 4-CYCLE ENGINE

BACKGROUND OF THE INVENTION

1. FIELD OF THE INVENTION

The present invention relates to a blow-by gas circulating system for a 4-cycle engine.

2. DESCRIPTION OF THE PRIOR ART

A blow-by gas circulating systems for a 4-cycle engine generally includes a crank case, a valve chest in cylinder head, and an oil separating chamber in a wall surface of a cam chamber or the like in a cylinder block. To prevent an oil mixed into a blow-by gas from entering into the oil separating chamber, it is desirable to provide the oil separating chamber at a position as high as possible in a normal operational attitude of the engine.

In a vertical crankshaft type 4-cycle engine with a crankshaft disposed substantially vertically, a cylinder head and a crank case are level with each other and hence, the provision of the oil separating chamber is not always adjacent the cylinder head, and in some cases, the oil separating chamber may be provided on an upper wall surface of the crank case (see Japanese Utility Model Application Laid-open No. 155,935/78 and Japanese Patent Publication No. 26,247/88).

It is also known that the oil separating chamber and an intake system are interconnected by a blow-by gas passage, so that a fuel mist is prevented from being released into the atmosphere (see Japanese Utility Model Application Laid-open No. 60,438/80 and Japanese Utility Model Publication No. 24,739/87).

In the device described in the above-described Japanese Utility Model Application Laid-open No. 60,438/80, the blow-by gas passage is connected to a connecting pipe mounted upstream of a carburettor, but because the blow-by gas passage partially overlie a mounting portion of the connecting pipe to the carburettor, there is a possibility that the connecting pipe mounting operation is obstructed by the blow-by gas passage.

In a single-cylinder vertical crankshaft type engine as described in Japanese Patent Publication No. 26,247/88, when the intake and exhaust systems are put in two, the intake system being located sideways of or slightly above the engine, there is a need for a provision for preventing the interference of an upper surface of the engine with a rotor such as a flywheel in connecting the blow-by gas passage to the intake system. However, in the device in which the blow-by gas passage is partially loosened in the middle of extension toward the intake system, as illustrated in FIG. 1 in Japanese Utility Model Publication No. 24,739/87, there is a possibility that the oil deposited on an inner wall surface of the blow-by gas passage flows from the intake system into a combustion chamber to exert an influence to the combustion state.

Even in the engine described in Japanese Utility Model Application Laid-open No. 155,935/78, there is likewise a need for a provision for making it difficult for the oil to be accumulated in the blow-by gas passage.

SUMMARY OF THE INVENTION

Accordingly, it is an object of the present invention to provide a blow-by gas circulating system for a 4-cycle engine, wherein the operation of mounting of an intake device to an intake system cannot be obstructed by the presence of the blow-by gas passage.

To achieve the above object, according to the present invention, there is provided a blow-by gas circulating system for a 4-cycle engine, comprising an engine, an engine cover for covering an upper portion of the engine, an air intake fixed to an inlet end of an intake system in the engine through a fixing means, and a blow-by gas passage which connects a connecting means provided in the air intake with the engine to permit a blow-by gas to be circulated therethrough to the intake system, wherein the connecting means provided in the air intake and the fixing means for fixing the air intake are disposed at positions which do not interfere with each other.

With the above construction, since the connecting means provided in the air intake and the fixing means for fixing the air intake are disposed at positions which do not interfere with each other, it is possible to easily conduct of the operation of attaching and detaching the blow-by gas passage to and from the connecting means of the air intake and the operation of attaching and detaching the air intake to and from the intake system.

In addition, to achieve the above object, according to the present invention, there is provided a blow-by gas circulating system for a 4-cycle engine, comprising an engine block supporting a crankshaft substantially vertically, a carburettor mounted in an intake passage connected to a combustion chamber within a cylinder head coupled to the engine block, an intake device fixed upstream of the carburettor by a fixing means, an oil separating chamber provided in an upper portion of the engine block, and a blow-by gas passage connecting the oil separating chamber and a connecting means provided on the intake device, wherein the intake device is a member substantially cylindrical in section, having, on its lower surface, the connecting means to which an end of the blow-by gas passage is connected in a downwardly directed fashion, and having a mounting flange joined to the carburettor at one end thereof and a downwardly directed opening at the other end thereof, the intake device being fixed at left and right opposite sides of the mounting flange thereof to the carburettor at a position level with or higher than the oil separating chamber by the fixing means.

With the above construction, since the connecting means is provided on the lower surface of the intake device fixed upstream of the carburettor, and the end of the blow-by gas passage is connected in the downwardly directed fashion to the connecting means, it is possible to avoid the interference between a tool and the blow-by gas passage in operating the fixing means for fixing the left and right opposite sides of the mounting flange of the intake device to the carburettor, thereby preventing a reduction in operability, and moreover, it is possible to shorten the length of blow-by gas passage connecting the intake device lying at a higher position with the oil separating chamber lying at a lower position.

To achieve the above object, according to the present invention, there is provided a blow-by gas circulating system for a 4-cycle engine, comprising an engine block supporting a crankshaft substantially vertically, a carburettor mounted in an intake passage connected to a combustion chamber within a cylinder head coupled to the engine block, an intake device fixed upstream of the carburettor by a fixing means, an oil separating chamber provided in an upper portion of the engine block, and a blow-by gas passage connecting the oil separating chamber and a connecting means provided on the intake device, wherein the intake device is a member substantially cylindrical in section, having, on its upper surface, the connecting means to which an end of the blow-by gas passage is connected in a downwardly directed fashion, and having a mounting flange joined to the carburettor at one end thereof and a downwardly directed opening at the other end thereof, the intake device being fixed at left and right opposite sides of the mounting flange thereof to the carburettor at a position level with or higher than the oil separating chamber by the fixing means.

With the above construction, since the connecting means is provided on the lower surface of the intake device fixed upstream of the carburettor, and the end of the blow-by gas passage is connected in the downwardly directed fashion to the connecting means, it is possible to avoid the interference between a tool and the blow-by gas passage in operating the fixing means for fixing the left and right opposite sides of the mounting flange of the intake device to the carburettor, thereby preventing a reduction in operability, and moreover, it is possible to shorten the length of blow-by gas passage connecting the intake device lying at a lower position with the oil separating chamber lying at a higher position.

The above and other objects, features and advantages of the invention will become apparent from a consideration of the following description of the preferred embodiments, taken in conjunction with the accompanying drawings.

BRIEF DESCRIPTION OF THE DRAWINGS

FIGS. 1 to 6 illustrate a first embodiment of the present invention, wherein FIG. 1 is a side view of the entire outboard motor;

FIG. 2 is an enlarged sectional view of an essential portion shown in FIG. 1;

FIG. 3 is a view taken along a line 3—3 in FIG. 2;

FIG. 4 is a view taken along a line 4—4 in FIG. 2;

FIG. 5 is a sectional view taken along a line 5—5 in FIG. 4; and

FIG. 6 is a view taken along a line 6—6 in FIG. 2;

FIGS. 7 to 13 illustrate a second embodiment of the present invention, wherein FIG. 7 is a side view of the entire outboard motor;

FIG. 8 is an enlarged sectional view of an essential portion shown in FIG. 7;

FIG. 9 is a view taken along a line 9—9 in FIG. 8;

FIG. 10 is an enlarged sectional view taken along a line 10—10 in FIG. 8;

FIG. 11 is an enlarged view of an essential portion shown in FIG. 8;

FIG. 12 is an enlarged view taken along a line 12—12 in FIG. 8; and

FIG. 13 is an enlarged view of an essential portion shown in FIG. 8;

FIGS. 14 to 19 illustrate a third embodiment of the present invention, wherein FIG. 14 is a side view of the entire outboard motor;

FIG. 15 is an enlarged view of an essential portion shown in FIG. 14;

FIG. 16 is a sectional view taken along a line 16—16 in FIG. 15;

FIG. 17 is an enlarged sectional view taken along a line 17—17 in FIG. 15;

FIG. 18 is an enlarged sectional view taken along a line 18—18 in FIG. 16; and FIG. 19 is an enlarged sectional view taken along a line 19—19 in FIG. 16.

DESCRIPTION OF THE PREFERRED EMBODIMENTS

Figure 1:
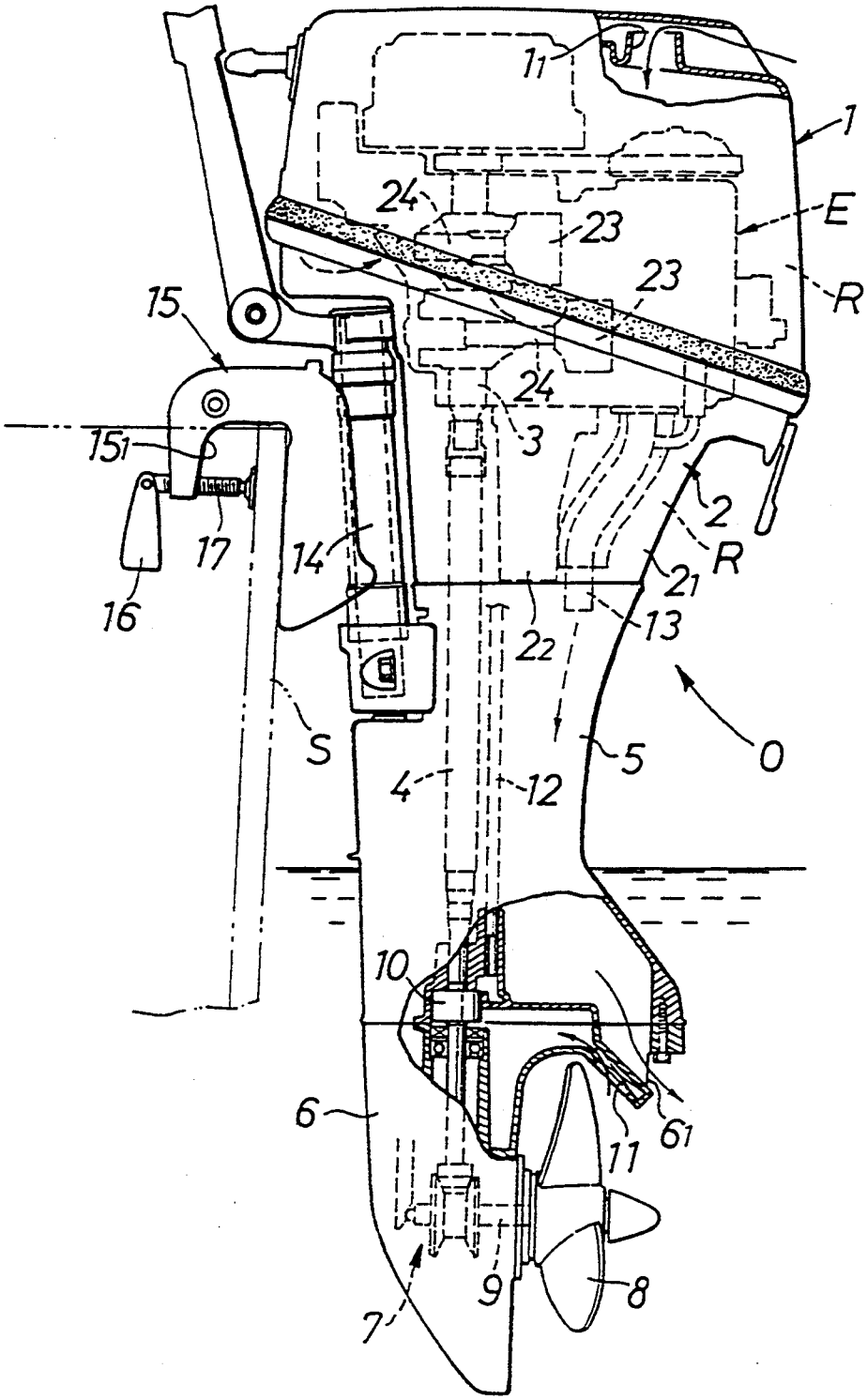

A first embodiment of the present invention will now be described in connection with FIGS. 1 to 6. Referring to FIG. 1, a 2-cylinder vertical engine E is mounted in an outboard motor O and covered with an upper cover and a lower case which define an engine room R and which are separable from each other. Specifically, the upper cover is an engine cover 1 for covering an upper half of the engine E, while the case is an oil case 2 integrally provided with a case portion $2_1$ and an oil pan portion $2_2$ for covering a lower half of the engine E. A driving shaft 4 is connected in series to a lower end of a crankshaft 3 of the engine E to extend downwards within an extension case 5 coupled to a lower portion of the oil case 2. A lower end of the driving shaft 4 is connected to a propeller shaft 9 having a propeller 8 at its rear end through a bevel gear mechanism 7 mounted within a gear case 6.

A cooling water is pumped through a filter 11 mounted at a rear portion of the gear case 6 by a cooling-water pump 10 mounted on a lower portion of the driving shaft 4, and is supplied upwards through a cooling-water pipe 12 to cool the engine E. A downward extending discharge pipe 13 is fixed to the engine E by means of a bolt 46. In coupling the engine E with the discharge pipe 13 mounted to the oil case 2, a lower end of the discharge pipe 13 is fixed to a lower wall of the oil case 2 by means of a bolt 18. An opening in the lower end of the discharge pipe 13 is opened into the extension case 5. An exhaust gas within the extension case 5 is discharged into the water through an exhaust gas outlet 61 which is opened into the rear portion of the gear case 6.

A stern bracket 15 for steerably supporting the outboard motor O through a swivel case 14 is fixed by means of a set screw 17 manipulated by a lever 16, with a groove $15_1$ with a lower end opened being in engagement with a stern S.

Figure 2:
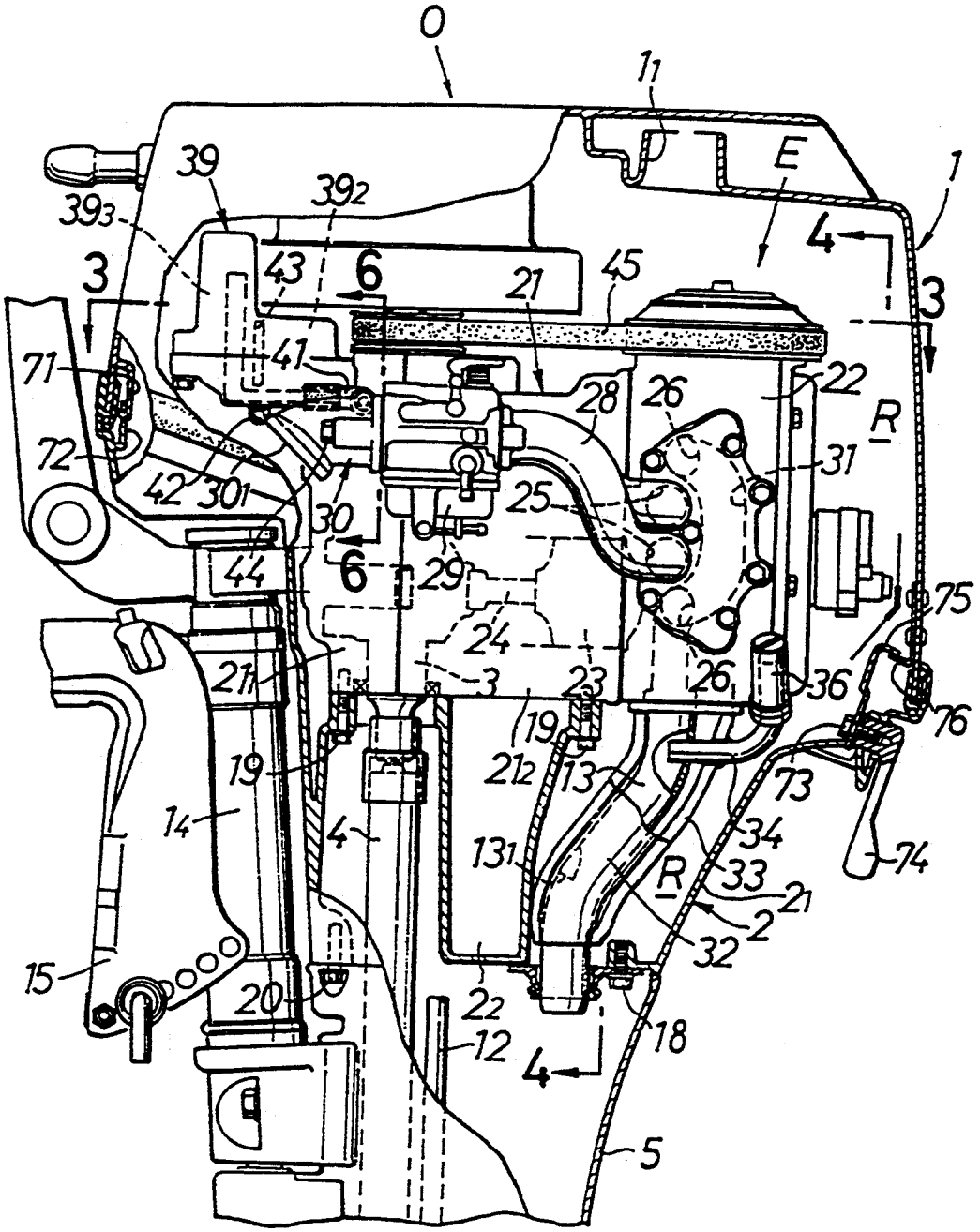
Figure 3:
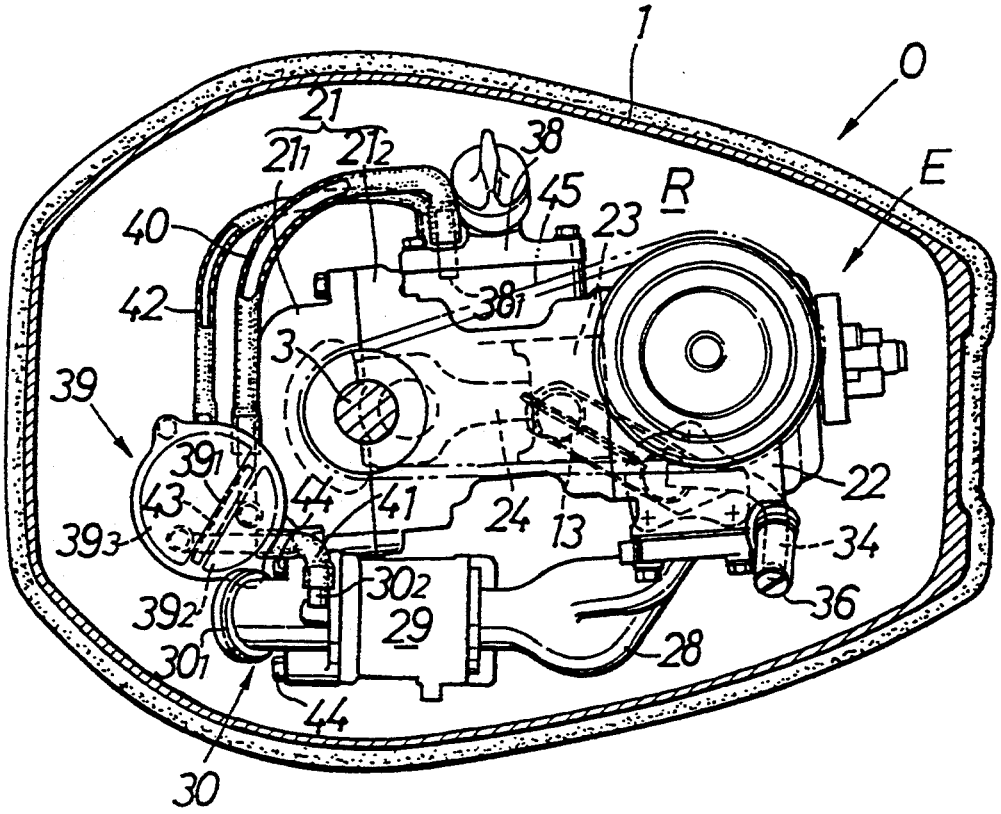
Figure 4:
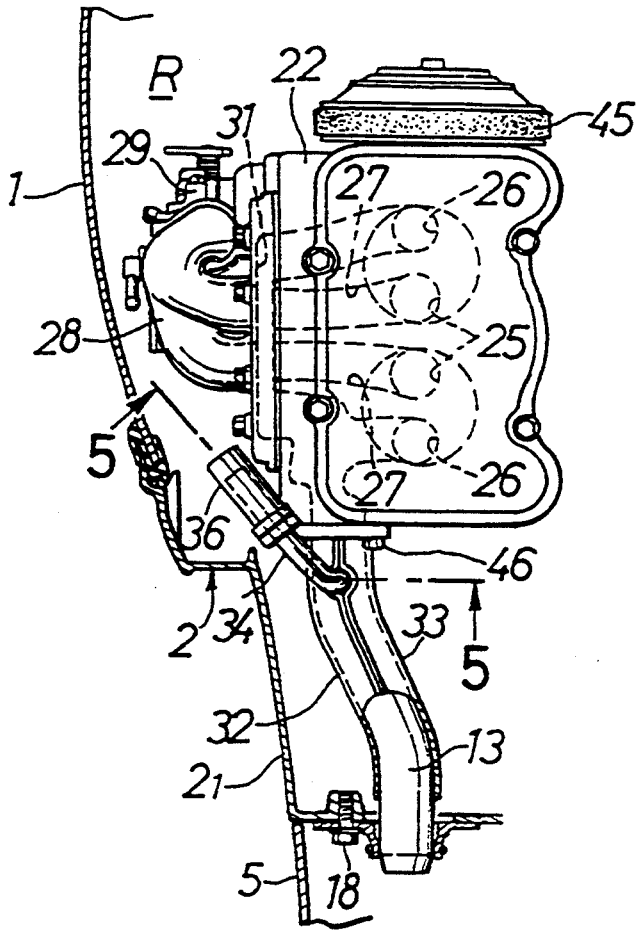

As can be seen from FIGS. 2 to 4, the engine E and the oil case 2 are coupled to each other by means of a plurality of bolts 19, and the extension case 5 and the oil case 2 are coupled to each other by means of a plurality of bolts 20. In addition, the oil case 2 and the engine cover 1 are locked at a front side of the outboard motor O by a hook 71 and a striker 72, and at a rear side of the outboard motor 0 by a hook lever 74 pivotable about an axis 73, a hook 75 pivotable in unison with the hook lever 74 and a striker member 76.

The engine E of the outboard motor O is longitudinally divided into two parts on a plane including an axis of the crankshaft 3, and includes a cylinder block 21 having a front crank case $21_1$ defining a portion of a crank chamber and a rear cylinder block portion $21_2$ including a skirt closing the remaining portion of the crank chamber, and a cylinder head 22 coupled to a deck surface of the rear cylinder block portion $21_2$. A pair of pistons 23, 23 are slidably received in the cylinder block 21 and connected to the crankshaft 3 through connecting rods 24, 24, respectively. The cylinder head 22 is provided with a pair of intake bores 25, 25 and a pair of exhaust bores 26, 26. The intake bores 25, 25 communicate with an air inlet $1_1$ opened into an upper portion of the engine cover 1, through two intake ports 27, 27 defined in the cylinder head 22, a bifurcated intake manifold 28, a carburettor 29 having a throttle valve mounted therein, and an air intake 30 opened into the engine cover 1. The exhaust bores 26, 26 communicate with an upper end of the exhaust pipe 13 through a bifurcated exhaust port $3_1$ defined in the cylinder head 22.

Figure 5:
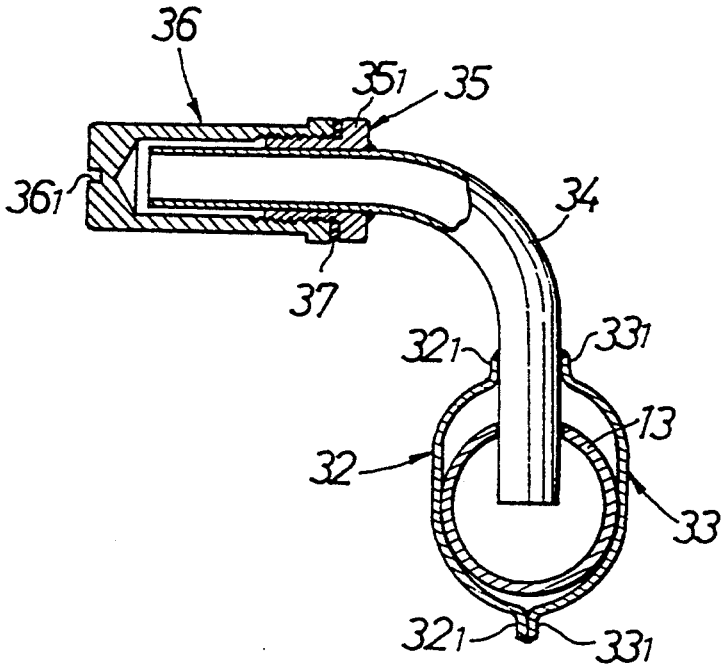

As can be seen from FIGS. 2 to 4 together with FIG. 5, an outer periphery of the exhaust pipe 13 is covered with two-divided exhaust pipe covers 32 and 33, and the cooling water introduced between inner peripheries of the exhaust pipe covers and the outer periphery of the exhaust pipe 13 is permitted to flow through a notch $13_1$ into the exhaust pipe 13 and then flow out of the latter into the extension case 5 together with an exhaust gas. The exhaust pipe covers 32, 33 are integrally welded along their flanges $32_1$ and $33_1$, and an exhaust gas sampling pipe 34 with its tip end inserted into the exhaust pipe 13 is welded around its outer periphery between the flanges $32_1$ and $33_1$. The exhaust gas sampling pipe 34 extending rearwardly from the exhaust pipe 13 is bent leftwardly at approximately 90°, and extends with its tip end reaching near a junction between the oil case 2 and the engine cover 1. In order to prevent the cooling water from flowing into the exhaust gas sampling pipe 34 to exert an adverse affection to an exhaust gas component measuring instrument, a mounting portion of the exhaust gas sampling pipe 34 is provided above the notch $13_1$ through which the cooling water is introduced into the exhaust pipe 13.

A threaded member 35 having a flange $35_1$ is welded to the tip end of the exhaust gas sampling pipe 34, and a plug 36 is threadedly fitted over the threaded member 35. Thus, when a tip end of a driver is engaged into a minus groove $36_1$ made in a base end of the plug 36 and then rotated, a sealing member 37 (e.g., washer) is clamped between the tip end of the plug 36 and the flange $35_1$ of the threaded member 35, thereby occluding the tip end of the exhaust gas sampling pipe 34.

In order to inject an oil into the cylinder block 21, an oil filler 38 is mounted in an opening in a cylinder block wall which communicates with an interior of the crank cheer. The crank chamber is connected with an oil separator 39 mounted in front of the engine E through a small hole 381 provided in the oil filler 38 and through a first blow-by gas passage 40. The separator 39 separates the oil and mist contained in a blow-by gas, in order to return the separated mist into an intake system, the oil separator 39 and the air intake 30 are connected to each other through a second blow-by gas passage 41.

An interior of the oil separator 39 is partitioned by a partition wall $39_1$ into a front chamber 392 connected to the first blow-by gas passage 40, and a rear chamber $39_3$ connected to the second blow-by gas passage 41. A bottom of the front chamber $39_2$ is connected with the oil filler 38 through an oil return passage 42 for returning the oil from the oil separator 39 into the cylinder block 21. A one-way valve 43 is mounted to the partition wall $39_1$ for restraining the back flow of the mist out of the rear chamber $39_3$ into the front chamber $39_2$.

Figure 6:
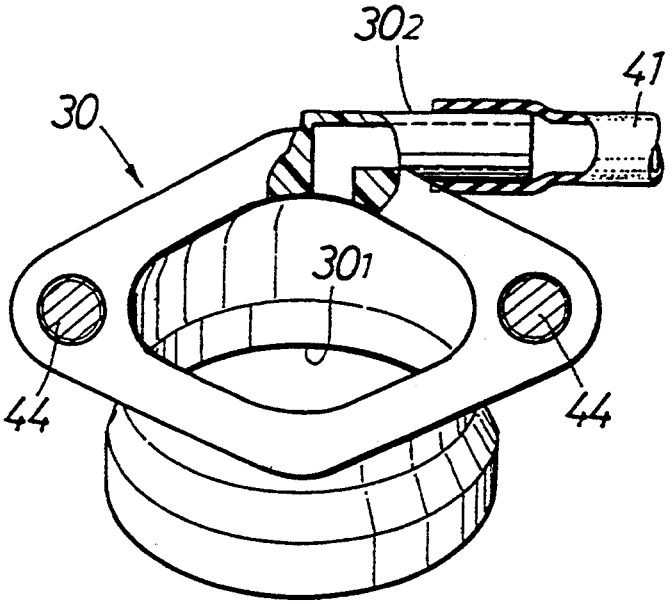

As can be seen from FIGS. 2, 3 and 6, the air intake 30 is fixed with its rear end face mated to a front end face of the carburettor 29 by means of two longitudinally extending bolts 44, 44. An air inlet 301 made in a front end of the air intake 30 is defined so as to be slightly curved downwards, such that water splash entering into the engine cover is prevented from being drawn into the intake system. The air intake 30 has a coupling portion $30_2$ integrally formed on its upper surface to extend toward the engine E perpendicularly to an axis of the air intake 30. The second blow-by gas passage 41 is connected to the coupling portion $30_2$. The coupling portion $30_2$ is disposed at a location offset upwards from axes of the two bolts 44, 44 fixing the air intake 30. Therefore, the attaching and detaching operations for the bolts 44, 44 and the second blow-by gas passage 41 can be performed without any problems. Moreover, since the coupling portion $30_2$ extends toward the engine E, i.e., away from the engine cover 1, there is no probability that the second blow-by gas passage 41 may be damaged, when the engine cover 1 is attached or detached.

It is noted here that reference character 45 in FIG. 2 designates an endless belt for transmitting the rotation of the crankshaft 3 to a valve-operating mechanism.

The operation of the first embodiment of the present invention having the above-described construction will be described below.

An open air drawn through the air inlet $1_1$ into the engine cover 1 is drawn through the air intake 30 into the carburetor 29, where it is mixed with a fuel. Then, the air-fuel mixture is supplied through the intake ports 27, 27 defined in the cylinder head 22 into a combustion chamber. An exhaust gas generated in the combustion chamber is introduced through the exhaust port 31 defined in the cylinder head 22 into the exhaust pipe 13, and is passed out of the latter through the inside of the extension case 5 and then discharged through the exhaust gas outlet $6_1$ into the water. During this time, the cooling water pumped by the cooling-water pump 10 mounted on the driving shaft 4 is passed through the inside of a water jacket (which is not shown) in the engine E, and a portion of such cooling water is supplied between the exhaust pipe 13 and the exhaust pipe covers 32 and 33 to cool the exhaust pipe 13. The cooling water which has cooled the exhaust pipe 13 flows through the notch 131 into the exhaust pipe 13 and is then discharged into the extension case 5 together with the exhaust gas.

A blow-by gas leaked out of the combustion chamber of the engine E into the cylinder block 21 is supplied through the first blow-by gas passage 40 into the oil separator 39. The mist resulting from the separation of the oil in the oil separator 39 is returned through the second blow-by gas passage 41 into the air intake 30 and is then supplied into the carburettor 29 together with the air flowing in the air intake 30. The oil separated in the separator 39 is returned through the oil return passage 42 and the oil filler 38 into the cylinder block 21.

Now, to examine the components in the exhaust gas from the engine E, a nut 20 having a lever may be first loosened to remove the engine cover 1 from the oil case 2, following which the plug 36 threadedly fitted over the tip end of the exhaust gas sampling pipe 34 may be removed, and instead, the exhaust gas component measuring instrument may be connected thereto.

When the measurement is to be carried out, the engine cover i is attached again to the oil case 2, but a piping such as a tube connected to the component measuring instrument is led from the air inlet 11 in the engine cover 1 or an opening in the oil case 2 occluded by a grommet or the like, to the outside of the outboard motor O.

Since the exhaust gas sampling pipe 34 is supported on the exhaust pipe 13 integral with the engine E and moreover, the tip end of the exhaust gas sampling pipe 34 is opened into the engine cover I and the oil case 2 without penetrating them, it is possible to easily perform the assembling of the engine E including the exhaust gas sampling pipe 34. Further, the plug 36 for occluding the tip end of the exhaust gas sampling pipe 34 is covered with the engine cover 1 and the oil case 2, such that it is shielded from seawater. Therefore, it is possible not only to avoid a disadvantage that salt is deposited to the minus groove 361 in the plug 36, thereby making it difficult for a tip end of a driver to engage the minus groove, and causing a rust or corrosion to be generated on the plug 36, so that the minus groove 361 is destroyed when the driver is rotated, but also to make the plug 36 inconspicuous to provide an improved appearance.

FIGS. 7 to 13 illustrate a second embodiment of the invention.

Figure 7:
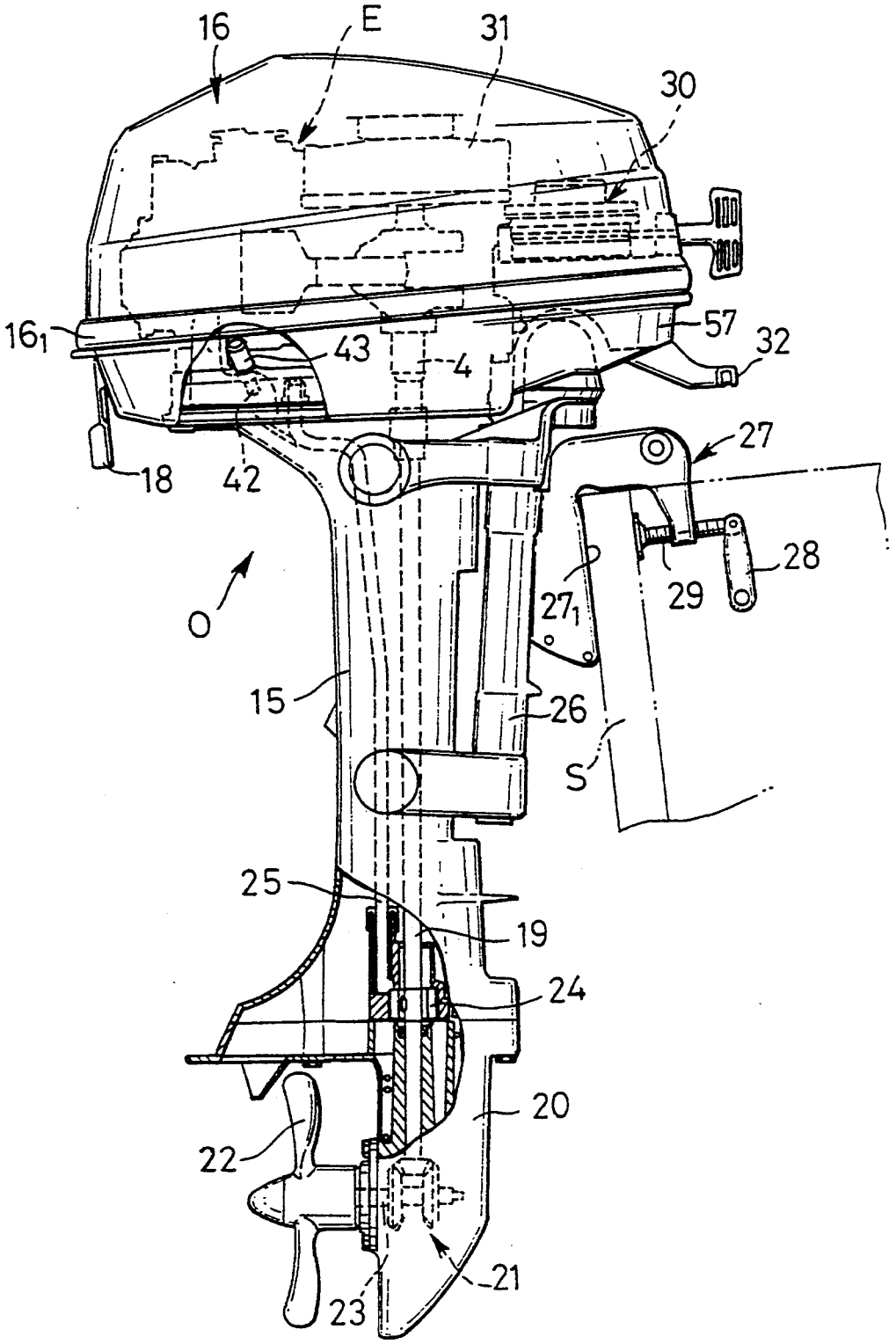
Figure 8:
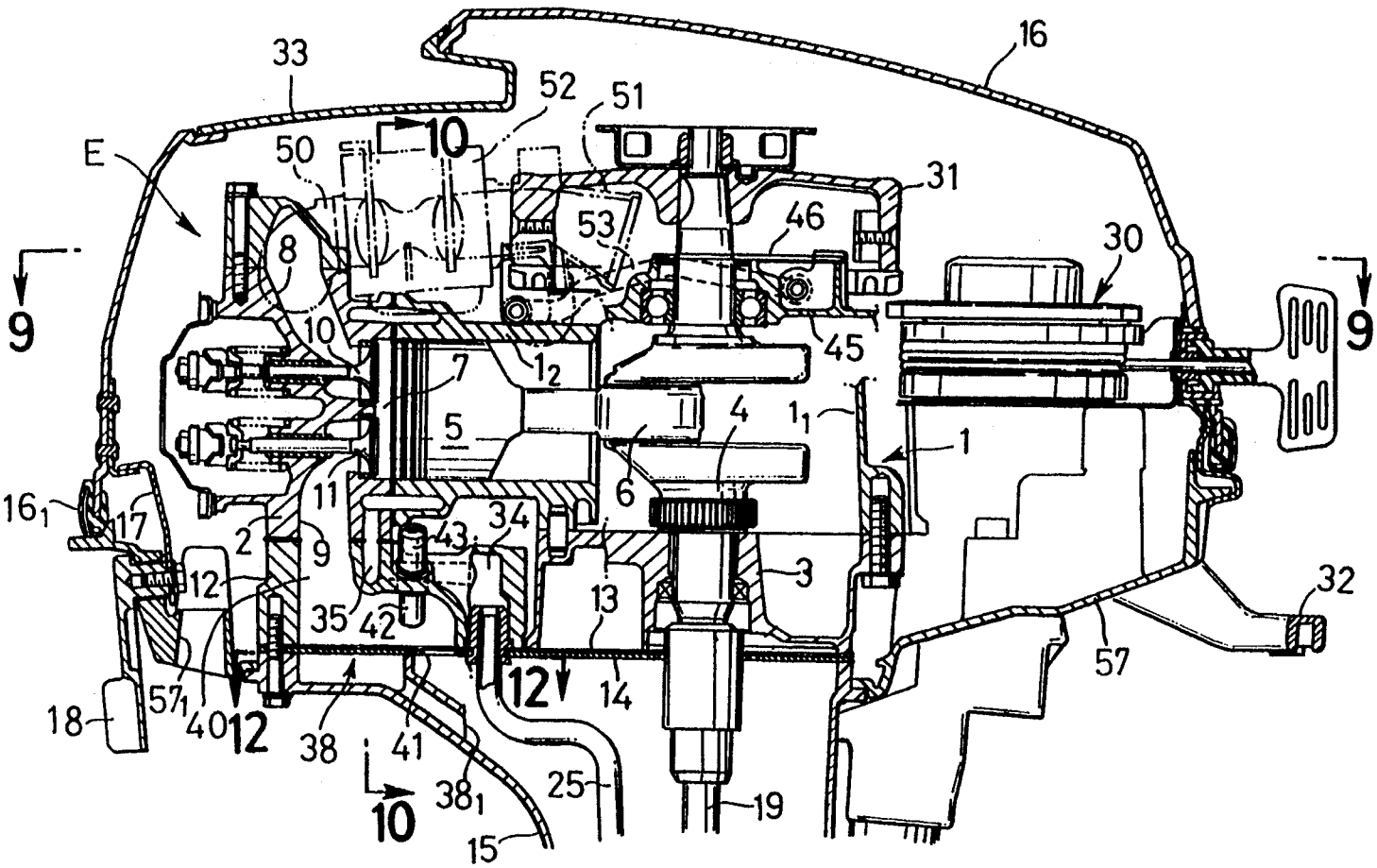

As shown in FIGS. 7 and 8, a single-cylinder type vertical engine E mounted in an upper portion of an outboard engine O includes an engine block 1 integrally provided with a crank case section $1_1$ and a cylinder block section $1_2$, and a cylinder head 2 coupled to the cylinder block portion $1_2$ of the engine block 1. A vertically disposed crankshaft 4 is rotatably supported at its opposite ends on an upper wall of the crank case section $1_1$ of the engine block i and on an oil pan 3 coupled to a lower portion of the crank case section $1_1$. A piston 5 is slidably received in the cylinder block section $1_2$ of the engine block 1 and connected to the crankshaft 4 through a connecting rod 6. An intake port 8 and an exhaust port 9 are defined in the cylinder head 2 and connected to a combustion chamber 7. The intake port 8 and an exhaust port 9 are opened and closed by an intake valve 10 and an exhaust valve 11 which are connected to a valve operating mechanism which is not shown.

A lower surface of an exhaust block $1_2$ coupled to a lower surface of the cylinder head 2, and a lower surface of the oil pan 3 are coupled to an upper surface of an extension case 15 through a gasket 13 and a partition plate 14 (see FIGS. 10 and 11), whereby the engine E is supported in an upper portion of the extension case 15. An undercase 57 is fixed to a peripheral edge of the upper surface of the extension case 15 by a bolt which is not shown. The undercase 57 has an opening in its upper surface, which is covered with an engine cover 16 of synthetic resin. The under case 57 and the engine cover 16 are separatably coupled to each other by a bracket 17 extending downwardly from the engine cover 16 and by a lever 18 for screwing the bracket 17. A sealing member $16_1$ is mounted around an outer periphery of the engine cover 16 for sealing a junction with the undercase 57.

A drive shaft 19 is connected in series to a lower end of the crankshaft 4 of the engine E and extends downwardly within the extension case 15. A lower end of the drive shaft 19 is connected to a propeller shaft 23 having a propeller 22 at its rear end through a bevel gear mechanism 21 mounted within a gear case 20. Thus, cooling water is pumped by a cooling water pump 24 provided at a lower portion of the drive shaft 19, and is supplied through a cooling water pipe 25 to the engine E.

A stern bracket 27 for steerably supporting the outboard motor O through a swivel case 26 is fixed by a set screw 29 operated by a lever 28 in a condition in which a groove $27_1$ opened at its lower end is in engagement with a stern S.

Figure 9:
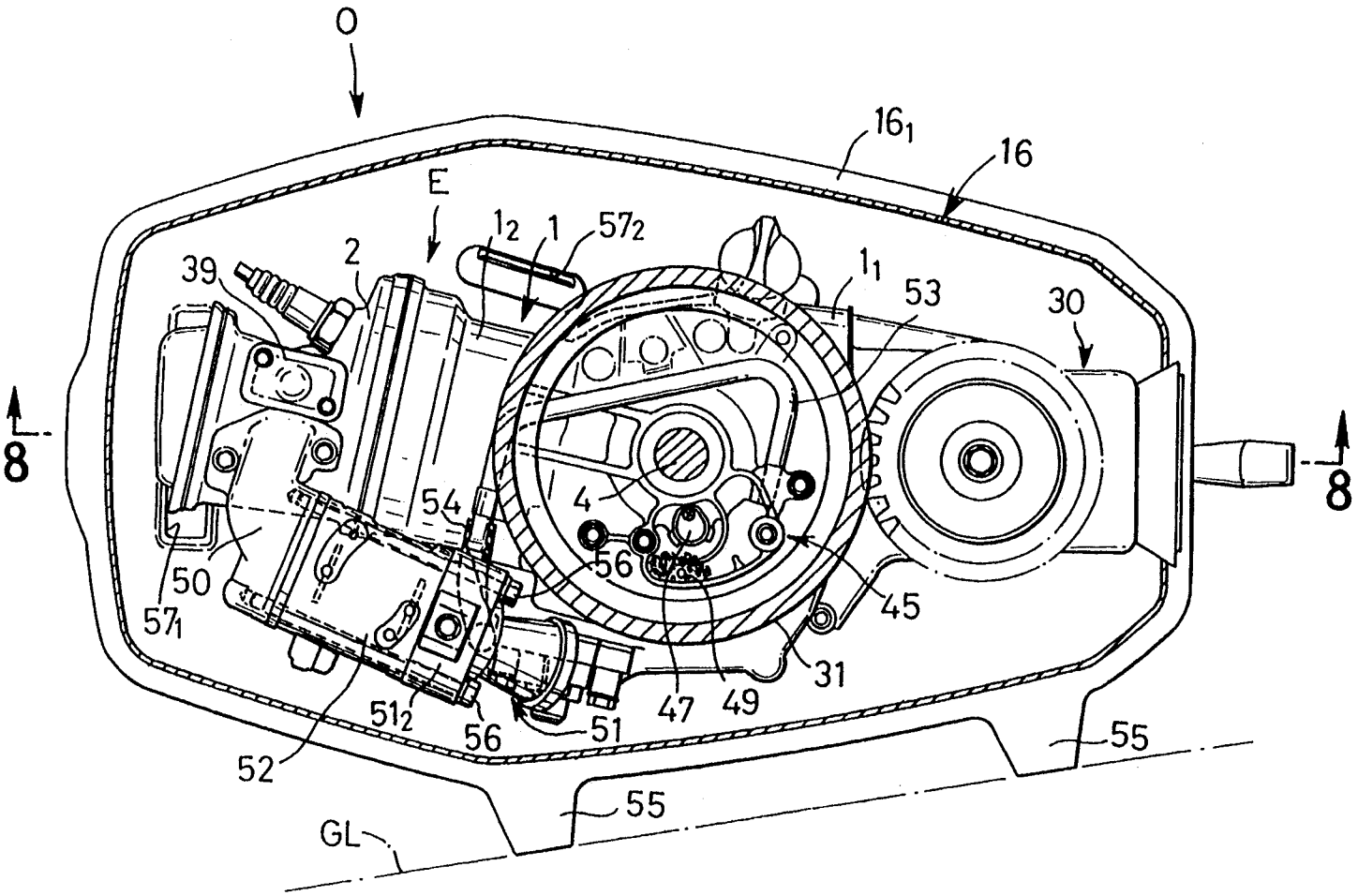
Figure 10:
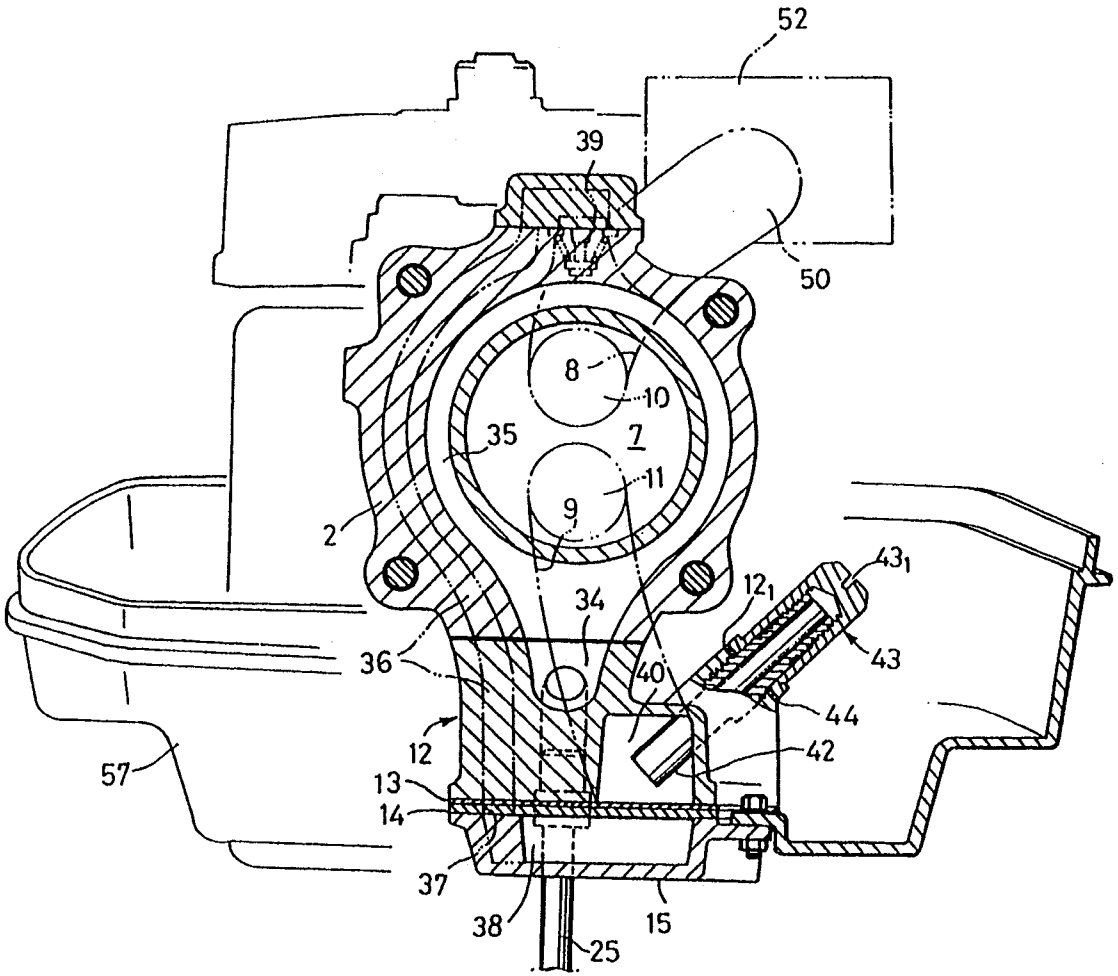
Figure 11:
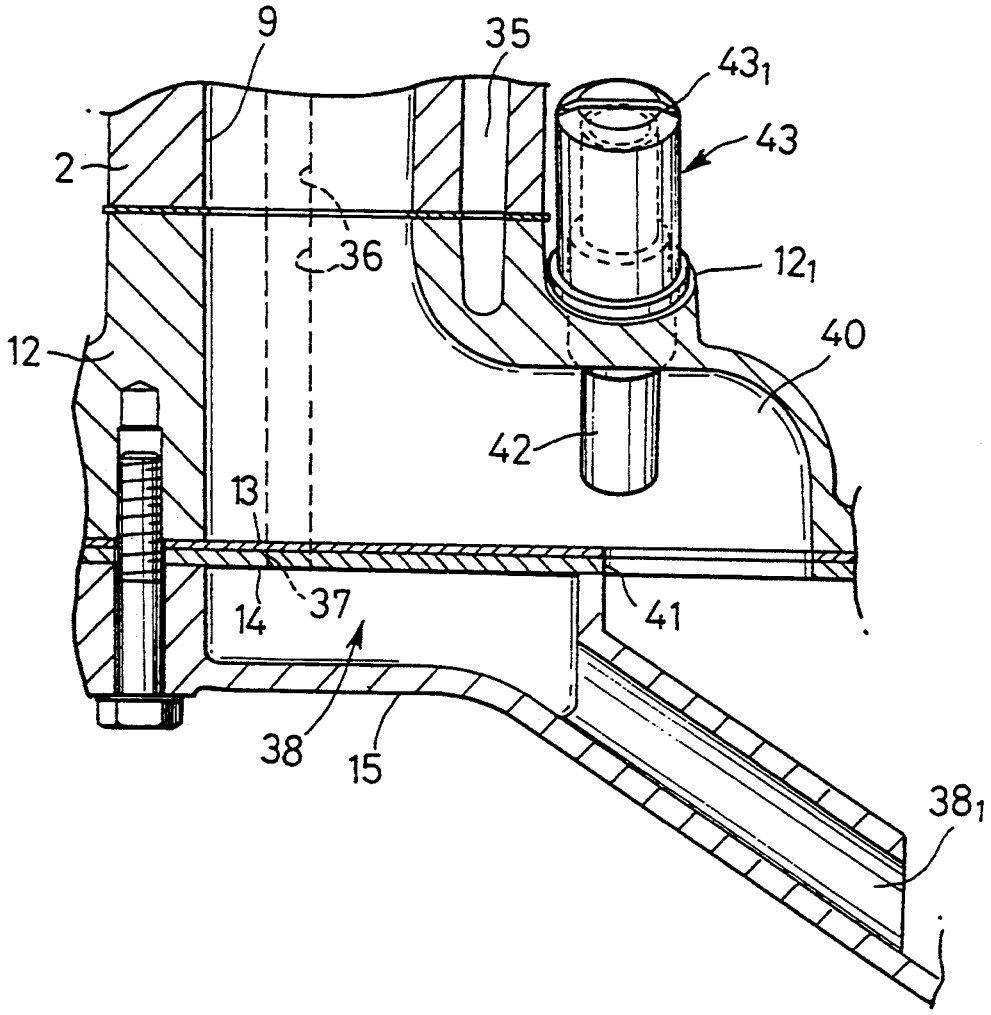
Figure 12:
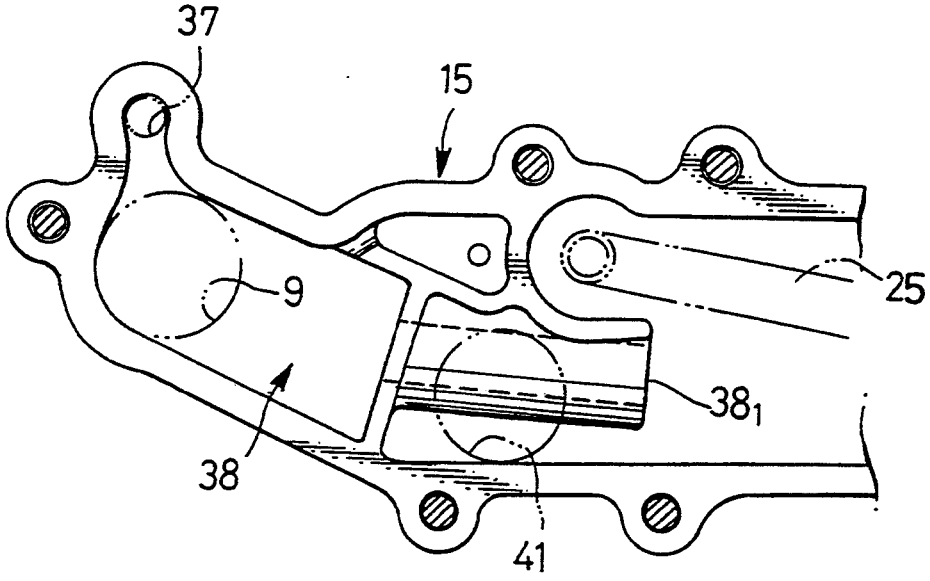

In FIG. 8, reference character 30 is a recoil starter; reference character 31 is a flywheel mounted at an upper end of the crankshaft 4; reference character 32 is a carrying handle for transporting the outboard motor O; and reference character 33 is a lid for closing a maintenance opening defined in the engine cover 16. Reference characters $57_1$ and $57_2$ in FIG. 9 are each an air inlet provided in the undercase 57 for introducing the open air into an engine room. The outboard motor O is steered by a steering handle which is not shown.

As can be seen from FIGS. 8 to 12, an upper end of the cooling water pipe 25 extending upwardly from the cooling water pump 24 is connected to a lower end of a cooling water passage 34 of an L-shape as viewed from the side, which is defined in the exhaust block 12. An upper end of the cooling water passage 34 in the exhaust block 12 is connected to a water jacket 35 formed in the cylinder head 2 and the cylinder block section $1_2$ so as to surround an outer periphery of the combustion chamber 7. The upper end of the water jacket 35 is connected to a cooling water passage 36 defined outside of the water jacket 35. The cooling water passage 36 extends downwardly within the cylinder head 2 and the exhaust block $1_2$ and communicates with a cooling water passage 38 defined between the partition plate 14 and the extension case 15 through an opening 37 defined in the gasket 13 and the partition plate 14. The cooling water passage 38 is opened into the extension case 15 through a drainage hole $38_1$.

Thus, the cooling water pumped by the cooling water pump 24 is discharged from the cooling water pipe 25 through the cooling water passage 34 in the exhaust block 12, the water jacket 35 in the cylinder head 2 and the cylinder block section 12, the cooling water passage 36 in the cylinder head 2 and the exhaust block 12, the opening 37, the cooling water passage 38 in the extension case 15 and the drainage hole 381 into the extension case 15, while cooling the cylinder head 2, the cylinder block $1_2$ and the exhaust block 12. It should be noted that during warming-up of the engine E, a thermostat 39 (see FIG. 10) mounted at an upper end of the water jacket 35 is closed to inhibit the flow of the cooling water, thereby promoting the warming-up of the engine E.

An exhaust passage 40 is defined in the exhaust block 12 and connected to the exhaust port 9 in the cylinder head 2. The exhaust passage 40 communicates with an interior of the extension case 15 through an opening 41 defined in the gasket 13 and the partition plate 14.

A flat seat surface $12_1$ inclined obliquely upwardly and leftwardly is formed on an outer wall surface of the exhaust block 12. An exhaust gas sampling pipe 42 including a straight stud pipe is threadedly inserted from the seat surface $12_1$ into a thick-formed wall surface of the exhaust block 12. The exhaust gas sampling pipe 42 passed through the exhaust block 12 is opened into the exhaust passage 40. A plug 43 having a minus groove $43_1$ engageable by a tip end of a driver is threadedly inserted into the exhaust gas sampling pipe 42, and the sealing member 44 is clamped between the plug 43 and the seat surface $12_1$ of the exhaust block 12, thereby occluding the opened end of the exhaust gas sampling pipe 42 to prevent a leakage of an exhaust gas.

In measuring the components of the exhaust gas, the engine cover 16 is separated from the undercase 57, and the plug 43 is removed from the exhaust gas sampling pipe 42. A tube connected to a component measuring instrument (not shown) is connected thereto and pulled outside from the air inlet $57_1$ or the $57_2$, and the engine cover 16 is closed, thereby enabling the sampling of the exhaust gas through the exhaust passage 40.

The exhaust gas sampling pipe 42 is supported in the exhaust block $1_2$ and located therewithin, so that the plug 43 occluding the tip end of the exhaust gas sampling pipe 42 is not passed through the engine cover 16 and the undercase 57. Therefore, the need for provision of an opening for permitting the exhaust gas sampling pipe 42 to be led outside is eliminated, leading to an improved sealability, but also by covering the plug 43 occluding the opened end of the exhaust gas sampling pipe 42 with the engine cover 16 and the undercase 15, it is possible to prevent the minus groove $43_1$ from being filled up or shallowed due to precipitated salt, rust or corrosion resulting from deposition of seawater, thereby influencing the workability. Moreover, it is possible to avoid the generation of a rust or corrosion due to the deposition of seawater on the exhaust block 12 to which the exhaust gas sampling pipe 42 is attached, and to prevent a degradation of appearance. Further, it is possible to prevent the exhaust gas sampling pipe 42 from being brought into contact with another object and damaged during transportation of the outboard motor O.

When the tube connected to the component measuring instrument is connected, the horizontal projecting of the exhaust gas sampling pipe 42 can be suppressed, because the exhaust gas sampling pipe 42 extends obliquely upwardly, thereby insuring a sufficient space between the peripheral edge of the opening at the upper end of the undercase 57 to facilitate the mounting of the tube. During this time, it is possible to prevent the interference between the tube and the components of the outboard motor O to further facilitate the mounting of the tube, because the exhaust gas sampling pipe 42 is inclined outside of the outboard motor O.

Figure 13:
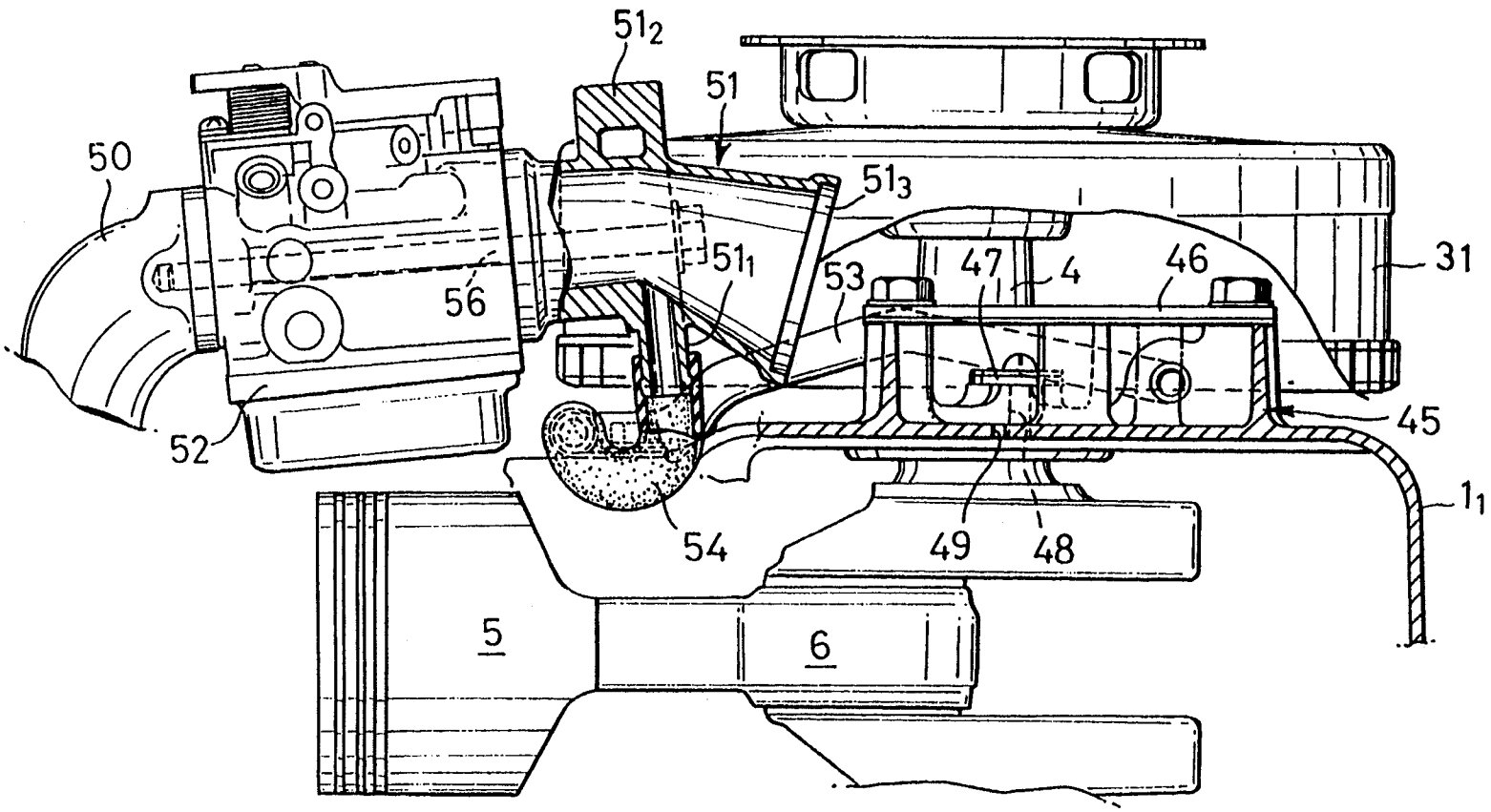

As can be seen from FIGS. 9 and 13, an oil separating chamber 45 is integrally defined in an upper wall of the crank case section $1_1$ of the engine block 1. A top surface of the oil separating chamber 45 is closed by a detachable lid 46, and an internal space in the oil separating chamber 45 and the interior of the crank case section $1_1$ communicate with each other through a blow-by gas passage 48 closed by a one-way valve 47 and through an oil return hole 49. The interior oil separating chamber 45 is partitioned in a labyrinth-like configuration, and an oil and mist contained in a blow-by gas flowing from the inside of the crank case section $1_1$ through the one-way valve 47 into the oil separating cheer 45 are separated. Then, the separated oil is returned by gravity through the oil return hole 49 defined in a bottom surface of the oil separating chamber 45 into the crank case section $1_1$. It should be noted that the oil return hole 49 is occluded by a steel wool.

An air intake 51 and a carburettor 52 are provided upstream of an intake pipe 50 connected to the cylinder head 2. The air intake 51 is a substantially cylindrical member including a mounting flange $51_2$ at an end thereof adjacent the carburettor 52 and a downwardly inclined opening 51, at the other end thereof. The air intake 51 and the carburettor 52 are co-fastened to the intake pipe 50 by two bolts 56, 56 passed through left and right sides of the mounting flange $51_2$. The air intake 51 is a member of a synthetic resin and is injection-molded by a vertically split metal mold. In this molding, a downwardly extending connector $51_1$ is integrally formed on a lower surface of the air intake 51.

A blow-by gas passage 53 comprises a metal pipe connected at its base end to a sidewall of the oil separating chamber 45 extends toward the air intake 51. A tip end of the passage 53 is connected to the connector $51_1$ of the air intake 51 through a blow-by gas passage 54 defined by a U-curved rubber joint. Thus, the mist resulting from separation of the oil in the oil separating chamber 45 is sucked by a suction negative pressure and drawn through the air intake 51 into the carburettor 52.

The air intake 51 is fixed to the carburettor 52 by two bolts 56, 56 passed through the left and right sides of the mounting flange $51_2$, but the connector $51_1$ connecting the blow-by gas passage 54 to the air intake 51 is provided on a lower surface of the air intake 51, and moreover, the blow-by gas passage 54 connected to the connector $51_1$ extends toward the oil separating chamber 45 in a U-curved configuration. Therefore, in attaching or detaching the air intake 51 by operation of the bolts 56, 56, the blow-by gas passage 54 cannot interfere with a tool to obstruct the working. In addition, since the connector $51_1$ is provided on the lower surface of the air intake located at a higher position, it is possible to shorten the length of each of the blow-by gas passages 53 and 54 extending from the connector $51_1$ to the oil separating chamber 45 located at a lower position.

As is apparent from FIG. 13, the blow-by gas passage 53 extends obliquely upwardly from the oil separating chamber 45 by utilizing an internal space in the flywheel 31 and then obliquely downwardly from its top point and is connected to the air intake 51. In this manner, a portion of the blow-by gas passage 53 near a connection thereof with the oil separating chamber 45 is inclined downwardly, thereby ensuring that a portion of the oil deposited and captured within the blow-by gas passage 53 is returned into the oil separating chamber 45 and is difficult to be resident therein. Therefore, it is possible to prevent the oil from being drawn into the intake system at one time.

As can be seen from FIG. 9, the outboard motor O removed from a hull is placed laterally, so that supporting projections 55, 55 come into contact with a ground surface GL, and at this time, the carburettor 52 is located below the cylinder head 2. The blow-by gas passage 53 interconnecting the oil separating chamber 45 and the air intake 51 is disposed in an inverted U-shaped configuration so as to pass above the crankshaft 4. This prevents the oil accumulated in the oil separating chamber 45 from flowing therefrom into the intake system, when the outboard motor O is placed in a horizontal attitude.

A third embodiment of the present invention will now be described with reference to FIGS. 14 to 19.

Figure 14:
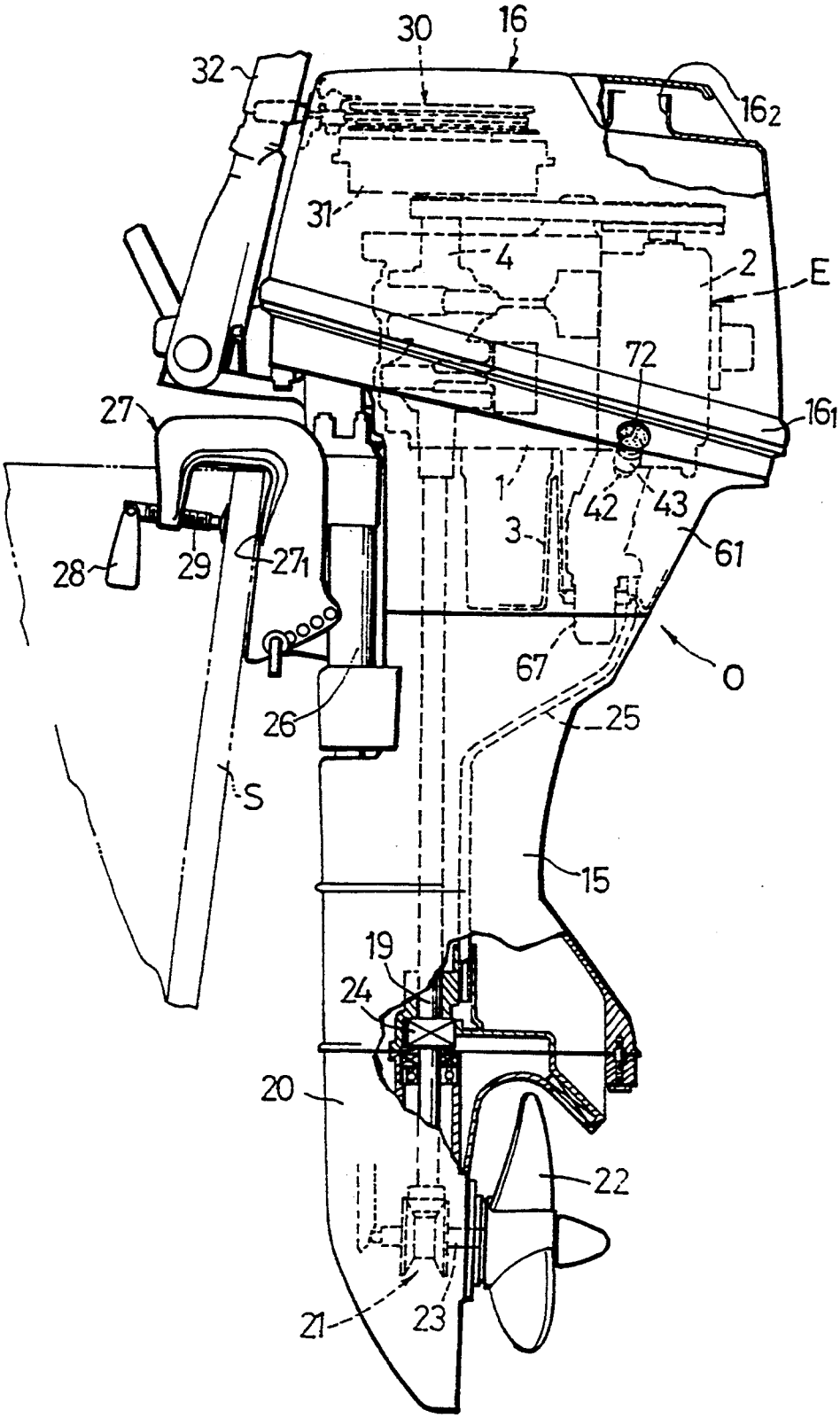

As shown in FIG. 14, an outboard motor O of the third embodiment includes an oil case 61 interposed between the extension case 15 and the engine block 1. An oil pan 3 is integrally formed within the oil case 61, and an engine cover 16 is detachably coupled to an opening at an upper end of the oil case 61.

Figure 15:
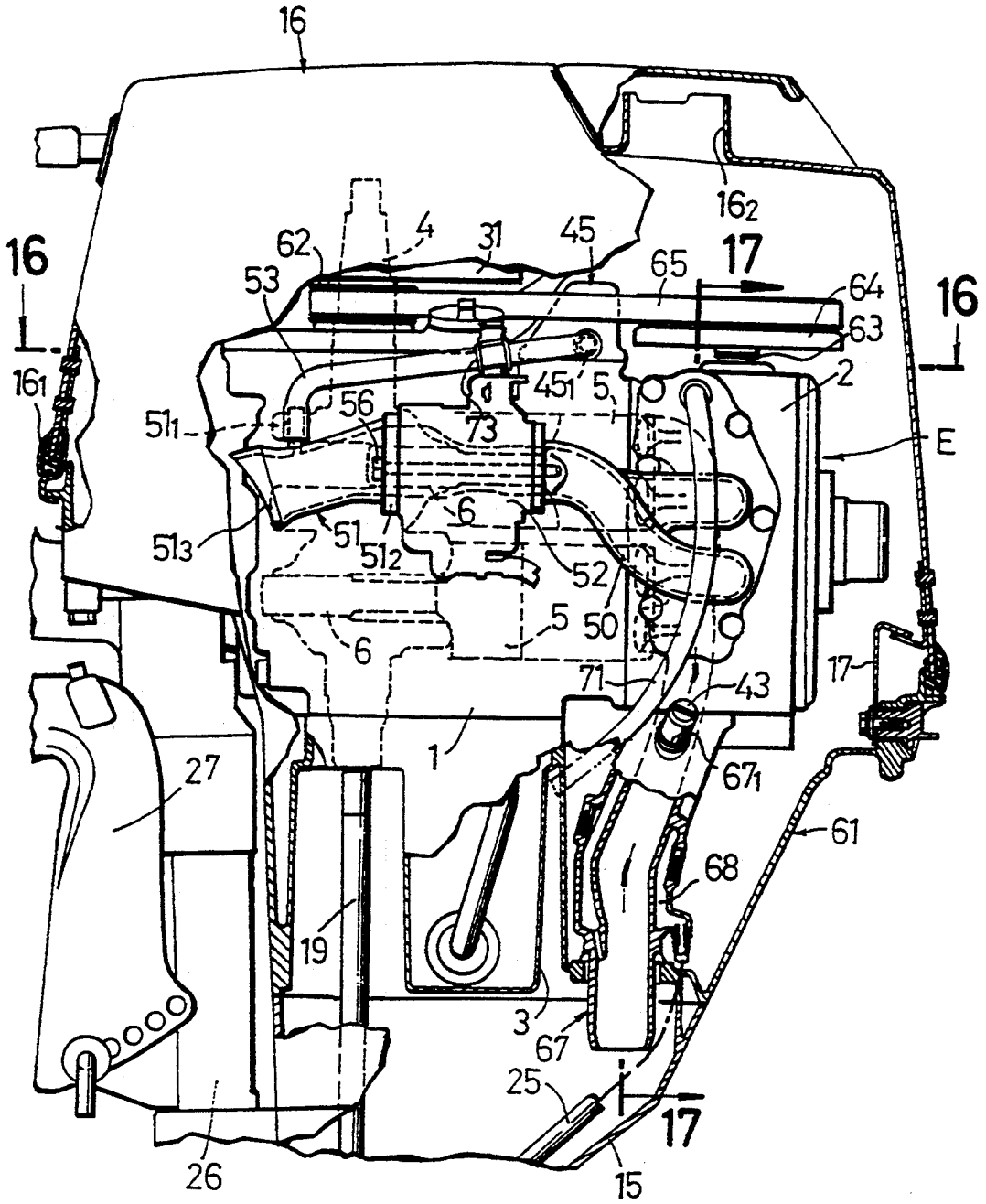
Figure 16:
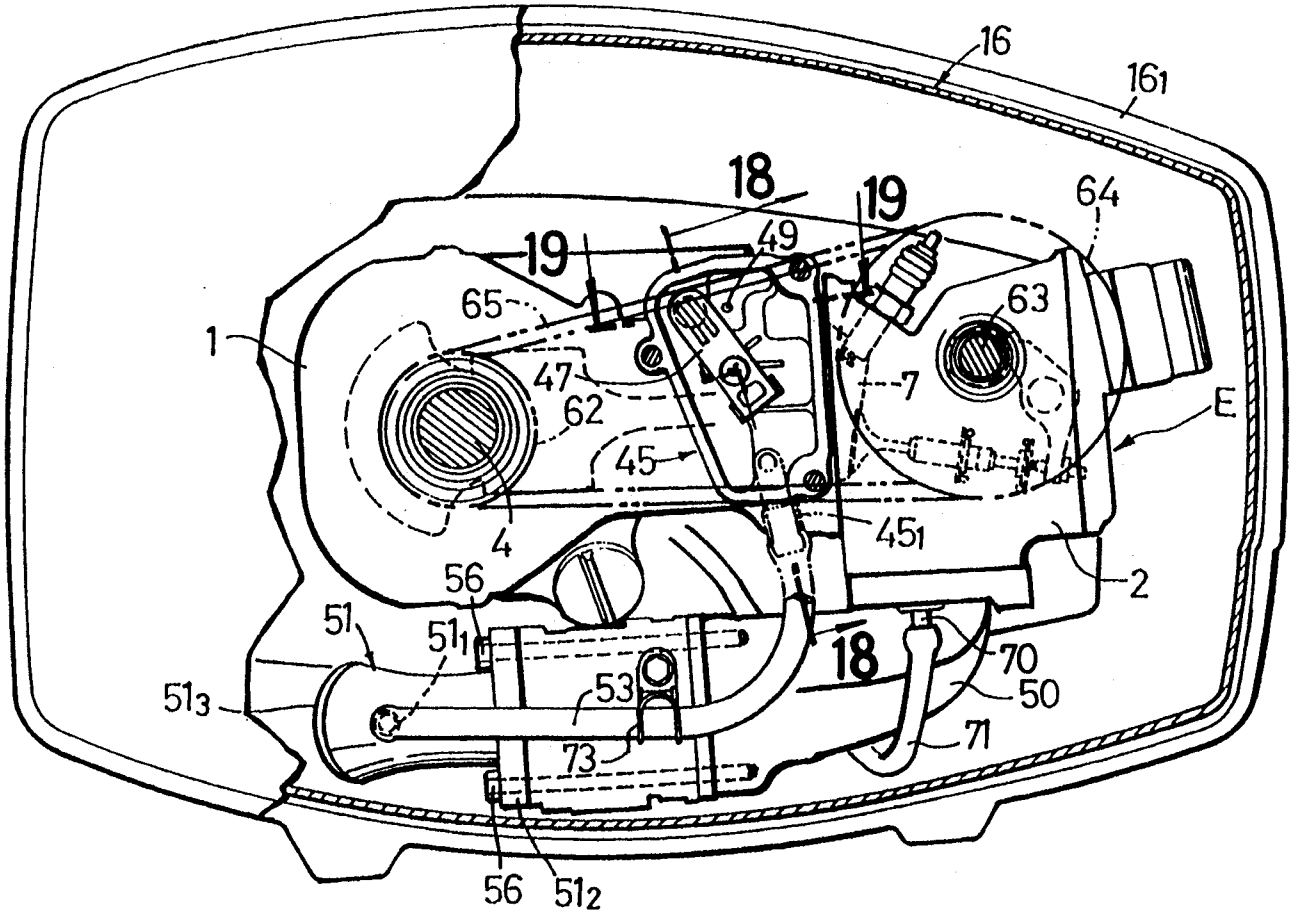

As shown in FIGS. 15 and 16, a 2-cylinder type vertical engine E accommodated in the engine cover 16 includes an engine block 1 supported at an upper end of the oil case 61, and a cylinder head 2 coupled to the engine block 1. A timing belt 65 is wound around a driving pulley mounted on a crankshaft 4 projecting upwardly from the engine block 1 and around a follower pulley 64 mounted on a cam shaft 63 projecting upwardly from the cylinder head 2. A carburettor 52 and an air intake 51 are connected to an front end of an intake pipe 50 extending from a left side of the cylinder head 2 toward the front of the outboard motor O.

Figure 17:
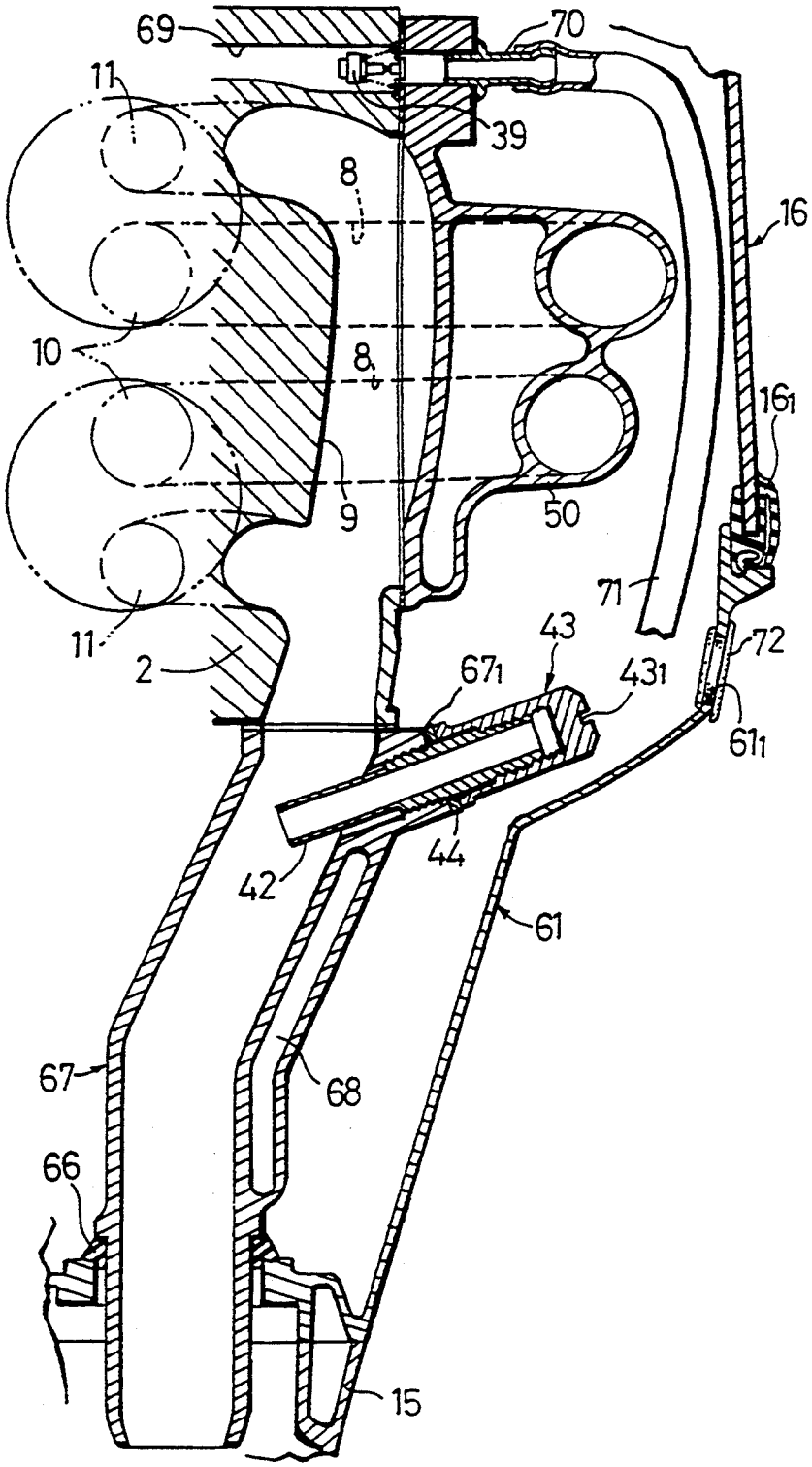
Figure 18:
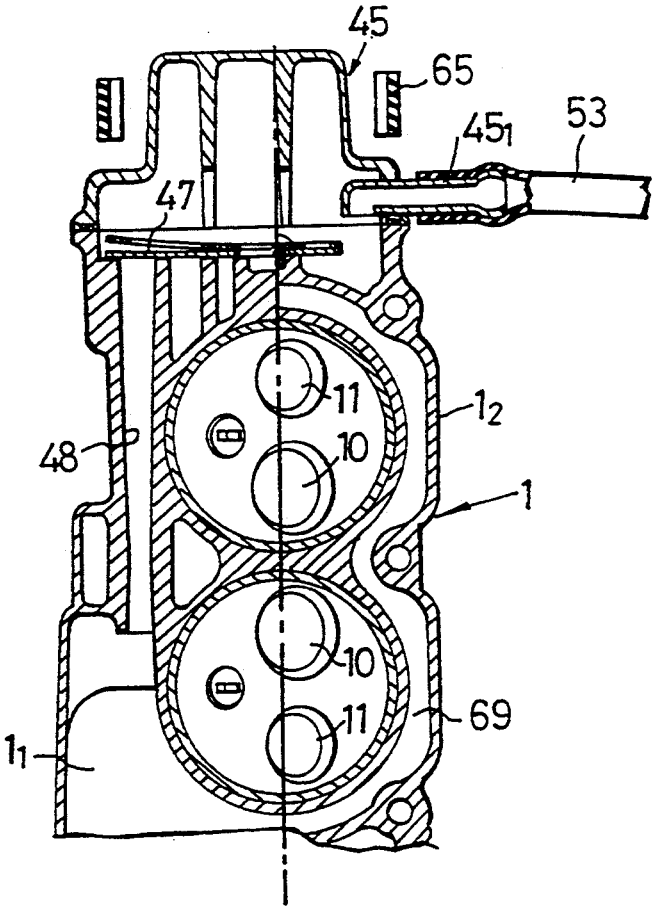
Figure 19:
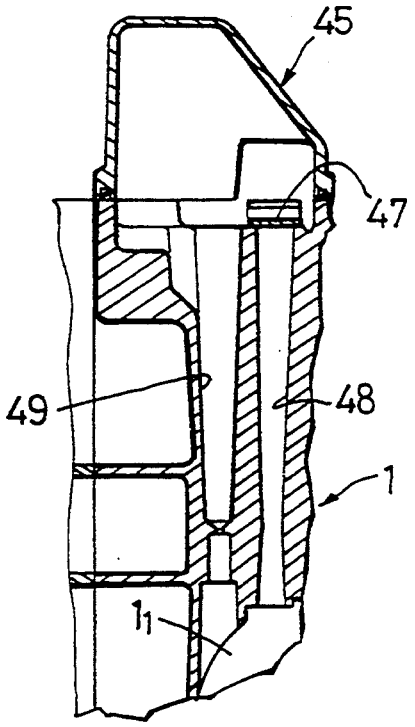

As can be seen from FIGS. 15, 17 and 18, an exhaust pipe 67 passed through the oil case 61 is coupled to a lower surface of the cylinder head 2 with a sealing member 66 interposed therebetween and is opened at its lower end into the extension case 15. A cooling water pipe 25 extending upwardly from a cooling water pump 24 (see FIG. 14) is connected to a lower end of a water jacket 68 defined around an outer periphery of the exhaust pipe 67. The water jacket 68 has an upper end connected to a lower end of a water jacket 69 (see FIG. 18) defined in the cylinder head 2 and the cylinder block section $1_2$ of the engine block 1. An upper end of the water jacket 69 in the cylinder head 2 is connected to a drainage pipe 71 through a thermostat 39 and a connector 70 (see FIG. 17) mounted on an outer wall of the intake pipe 50. The drainage pipe 71 extends downwardly and is opened into an internal space in the extension case 15.

A flat seat surface $67_1$ inclined obliquely upwardly and leftwardly is formed on a thicker portion of the exhaust pipe 67 in the vicinity of its upper end. An exhaust gas sampling pipe 42 is threadedly inserted into the seat surface $67_1$ and has either the same structure as the exhaust gas sampling pipe 42 in the second embodiment or a structure in which a cylindrical threaded portion is integrally formed around an outer periphery of a straight pipe by welding or the like. A plug 43 threadedly inserted into a tip end of the exhaust gas sampling pipe 42 is accommodated in an internal space in the oil case 61, and an opening $61_1$ is defined in the oil case 61, so that a tip end of a driver is brought into engagement in a minus groove 431 in the plug 43 to remove the plug 43 from the exhaust gas sampling pipe 42. The opening $61_1$ in the oil case 61 is closed by a detachable cap 72 of a rubber to prevent the ingress of water.

In measuring components in an exhaust gas, the engine cover 16 may be separated from the oil case 61, following which the plug 43 loosened by insertion of a driver through the opening $61_1$ with the cap 72 removed therefrom may be removed from the opening in the upper surface of the oil case 61, which is provided by removal of the engine cover 16, and a tube of a component measuring instrument inserted through the air inlet $16_2$ (see FIG. 15) in the engine cover 16 may be connected to the opened end of the exhaust gas sampling pipe 42. It should be noted that the opening $61_1$ in the oil case 61 may be of a larger diameter, so that the plug 43 can be removed, or tube can be removed. However, if the opening $61_1$ is of a smaller diameter, the provision of a smaller cap 72 suffices.

Even with the third embodiment, it is possible to cover the plug 43 occluding the tip end of the exhaust gas sampling pipe 42 with the engine cover 16 and the oil case 61 to protect the plug 4 against a rust due to the deposition of seawater. Moreover, it is possible to prevent the exhaust gas sampling pipe 42 from being brought into contact with another object and damaged during transportation of the outboard motor O. The horizontal projecting of the exhaust gas sampling pipe 42 can be suppressed by oblique upward inclination of the exhaust gas sampling pipe 42, thereby insuring a space used for the mounting of the tube between the peripheral edge of the opening at the upper end of the oil case 61 to facilitate the mounting of the tube. Moreover, it is possible to prevent the interference between the tube and the components of the outboard motor O by the inclination of the exhaust gas sampling pipe 42 outside of the outboard motor O.

As can be seen from FIGS. 15, 16, 18 and 19, an oil separating chamber 45 is provided in an upper surface of the engine block 1 to lie between a tensioned side and loosened side of the timing belt 65. The inside of the oil separating chamber 45 communicates with the inside of the crank case section $1_1$ through the blow-by gas passage 48 extending vertically through a sidewall of the crank case section $1_1$. A one-way valve 47 for opening and closing the blow-by gas passage 48 is mounted in a bottom wall of the oil separating chamber 45, and the inside of the oil separating chamber 45 communicates with the inside of the crank case section $1_1$ through the oil return hole 49.

An air intake 51 and a carburettor 52 are co-fastened to the intake pipe 50 connected to the cylinder head 2 by two bolts 56, 56. The air intake 51 of a synthetic resin injection-molded by a vertically split metal mold as in the fourth embodiment and includes a mounting flange $51_2$ and an opening $51_3$ at opposite ends thereof, but a connector $51_1$ is integrally formed in an upwardly directed manner on an upper surface of the air intake 51, unlike the second embodiment.

The blow-by gas passage 53 made of a flexible pipe connecting the connector $45_1$ provided on the oil separating chamber 45 with the connector $51_1$ provided on the air intake 51 extends from the oil separating chamber 45 and is declined monotonously from a location beyond the upper surface of the engine E toward the air intake 51, with its intermediate portion fixed to an upper surface of the carburettor 52 by a clip 73 (see FIG. 15). Because the blow-by gas passage 53 has no loosened portion in this manner, an oil deposited on a wall surface of the blow-by gas-passage 53 flows promptly into the air intake 51 without residence. A small amount of oil flowing into the blow-by gas passage 53 is discharged into the air intake at every time and thus, the sudden flowing of a large amount of oil into the intake system is prevented.

Since the two left and right bolts 56, 56 for fixing the air intake 51 to the carburettor 52 lie at locations spaced apart from the blow-by gas passage 53 extending upwardly from the connector $51_1$ provided on the air intake 51, it is possible to easily conduct the attaching and detaching of the air intake 51 by operation of the bolts 56, 56. In addition, since the connector $51_1$ is provided on the upper surface of the air intake 51 lying at the lower position, it is possible to shorten the length of the blow-by gas passage 53 extending from the connector $51_1$ to the oil separating chamber 45 lying at the higher position.

What is claimed is:

1. A blow-by gas circulating system for a 4-cycle engine, comprising an engine block supporting a crankshaft substantially vertically, a carburettor mounted in an intake passage connected to a combustion chamber within a cylinder head coupled to said engine block, an intake device fixed upstream of said carburettor by a fixing means, an oil separating chamber provided in an upper portion of said engine block, and a blow-by gas passage connecting said oil separating chamber and a connecting means provided on said intake device, wherein said intake device is a member substantially cylindrical in section, having, on its lower surface, said connecting means to which an end of the blow-by gas passage is connected in a downwardly directed fashion, and having a mounting flange joined to said carburettor at one end thereof and a downwardly directed opening at the other end thereof, said intake device being fixed at left and right opposite sides of said mounting flange thereof to said carburettor at a position level with or higher than said oil separating chamber by said fixing means.

2. A blow-by gas circulating system for a 4-cycle engine according to claim 1, wherein said blow-by gas passage has a falling gradient toward said oil separating chamber in the vicinity of a connection thereof with said oil separating chamber.

3. A blow-by gas circulating system for a 4-cycle engine, comprising an engine block supporting a crankshaft substantially vertically, a carburettor mounted in an intake passage connected to a combustion chamber within a cylinder head coupled to said engine block, an intake device fixed upstream of said carburettor by a fixing means, an oil separating chamber provided in an upper portion of said engine block, and a blow-by gas passage connecting said oil separating chamber and a connecting means provided on said intake device, wherein said intake device is a member substantially cylindrical in section, having, on its upper surface, said connecting means to which an end of said blow-by gas passage is connected in a downwardly directed fashion, and having a mounting flange joined to said carburettor at one end thereof and a downwardly directed opening at the other end thereof, said intake device being fixed at left and right opposite sides of said mounting flange thereof to said carburettor at a position lower than said oil separating chamber by said fixing means.

4. A blow-by gas circulating system for a 4-cycle engine according to claim 3, wherein said connecting means is provided at a position lower than said oil separating chamber.

* * * * *